US005345700A

United States Patent [19]

Norment

[11] Patent Number: 5,345,700

[45] Date of Patent: Sep. 13, 1994

[54] ATHLETIC SHOE WITH REPLACEABLE UNITARY ASSEMBLY FOR GENERATING AND BROADCASTING AN AUDIBLE SIGNAL

[75] Inventor: Vincent E. Norment, Baltimore, Md.

[73] Assignee: Leonard Bloom, Towson, Md. ; a part interest

[21] Appl. No.: 93,976

[22] Filed: Jul. 19, 1993

Related U.S. Application Data

[63] Continuation of Ser. No. 828,564, Jan. 31, 1992, abandoned.

[51] Int. Cl.[5] ..... A43B 23/00

[52] U.S. Cl. ..... 36/139; 36/136

[58] Field of Search ..... 36/139, 136, 132, 137; 2/250, 249, 247; 381/51

[56] References Cited

U.S. PATENT DOCUMENTS

| | | | |
|---|---|---|---|
| 2,940,184 | 6/1960 | Malone | 36/139 |
| 4,043,241 | 8/1977 | Liu | 36/139 |
| 4,646,350 | 2/1987 | Batra | 36/139 |
| 4,697,363 | 10/1987 | Gamm | 36/136 |
| 4,771,556 | 9/1988 | Kim | 36/139 |
| 4,825,471 | 5/1989 | Jennings | 2/247 |

FOREIGN PATENT DOCUMENTS

| | | | |
|---|---|---|---|
| 0335467 | 10/1989 | European Pat. Off. | 36/139 |
| 1447044 | 6/1966 | France | 36/136 |

*Primary Examiner*—Steven N. Meyers
*Attorney, Agent, or Firm*—Leonard Bloom

[57] ABSTRACT

An athletic shoe for playing basketball and the like has an inner side portion with a pocket formed therein, and an integral unitary assembly is slidably received within the pocket and is retained therein by means of a flap carried by the shoe, the flap and shoe having cooperating hook-and-loop fasteners, respectively. The unitary assembly includes a board having a battery, microchip, audio speaker and on/off switch carried thereon and electrically connected together. A push button is carried by the shoe and overlays the switch when the unitary assembly is received in the pocket. The push button may be pushed to close the switch, so as to energize the microchip from the battery and generate an audible signal. One example of the audible signal is an inspirational message (such as "have a happy face, stay away from drugs").

7 Claims, 4 Drawing Sheets

ATHLETIC SHOE WITH REPLACEABLE UNITARY ASSEMBLY FOR GENERATING AND BROADCASTING AN AUDIBLE SIGNAL

This application is a continuation of application Ser. No. 828,564, filed Jan. 31, 1992, abandoned.

FIELD OF THE INVENTION

The present invention to athletic shoes that incorporate therein a unitary assembly for generating and broadcasting an audible signal, such as a musical composition, a message or the like.

BACKGROUND OF THE INVENTION

The desirability of providing footwear that incorporate therein assemblies that emit noises and/or similar sounds has long been known. Such devices, of which I am aware, are disclosed in the following United States Letters Patents:

| Inventor | U.S. Pat. No. | Year of Issue |
|---|---|---|
| Schreck | 2,160,756 | 1939 |
| Casserd | 2,291,791 | 1942 |
| Miles | 2,735,220 | 1956 |
| Faranda | 2,811,811 | 1957 |
| Magiera | 3,340,846 | 1967 |
| Visitacion | 3,432,964 | 1969 |
| Schmidt | 3,501,144 | 1970 |
| Strelakos | 3,757,466 | 1973 |

It is noted that each of the above patents involve the incorporation of various mechanical noise-making assemblies with foot apparel. The noises created by these mechanical assemblies are not electronically generated. Further, it is noted that there is no suggestion in any of those disclosures of any arrangement that could electrically amplify or broadcast the mechanical noises made by the assemblies. Thus, it is clear that the arrangements of these disclosures are not capable of either generating or broadcasting either musical compositions or messages, nor do they lend themselves to being adapted for that purpose.

It has also been known to incorporate various electrical circuitry with foot apparel to provide for the pick-up and broadcasting of noises, such as is disclosed in U.S. Pat. No. 4,660,305 issued to Medler, et al., and U.S. Pat. No. 5,001,852 issued to Schwartz. However, in both of these disclosures, the various components of the electrical circuitry are individual, and there is no suggestion therein to form such circuitry into a unitary assembly. Rather, in each case, the speakers for broadcasting the audible signal are remote from the shoe. Indeed, neither of these arrangements is capable of being formed into a unitary assembly.

Furthermore, like the disclosures noted above, in both Medler '305 and Schwartz '852, the noises to be broadcasted are mechanical noises make by mechanical elements (such as taps). It is noted that there is no suggestion in either of those disclosures of any arrangement that could electrically generate a noise. Thus, it is clear that the arrangements of these disclosures are not capable of either generating either musical compositions or messages, nor do they lend themselves to being adapted for that purpose.

It has also been known to incorporate electronic circuitry with foot apparel for purposes other than to simply emit and/or amplify noises.

U.S. Pat. Nos. 3,702,999 issued to Grandisar; 3,791,375 issued to Pfeiffer; and 4,814,661 issued to Ratzlaff et al. each disclose arrangements that provide force (or weight) bearing sensing and warning systems. However, like the disclosures discussed above, none of the circuitry of these arrangements are unitary assemblies. Rather, in each of these disclosures, the circuitry includes speakers that are remote from the remainder of the subassembly.

U.S. Pat. Nos. 4,402,147 issued to Wu; 4,466,204 issued to Wu; 4,510,704 issued to Johnson; and 4,651,446 issued to Yukawa et al each disclose pedometers. However, none of these disclosures involve assemblies that are capable of either generating or broadcasting an audible signal. Thus, the arrangements of these disclosures are not capable of generating or broadcasting either musical compositions or messages, nor do they lend themselves to being adapted for that purpose. Furthermore, once again, the assemblies of these disclosures are not unitary. The only disclosures of which I am aware that incorporate devices or circuitry with foot apparel that emit musical compositions are U.S. Pat. Nos. 2,940,184 issued to Malone and 4,771,556 issued to Kim.

U.S. Pat. No. 2,940,184 issued to Malone discloses a mechanical arrangement that is built into the heel of a high heel shoe. This mechanical arrangement is comprised of several separate components, and not a unitary assembly. Also, this arrangement is not capable of either electronically generating or broadcasting either a musical composition or a message. Furthermore, it is noted that the mechanical arrangement disclosed therein is quite complicated, involving a spring-driven music box mechanism. Unfortunately, the complexity of such a mechanical arrangement can be quite expensive and weighty, so as to affect the user's comfort. Also, such a complicated mechanical arrangement can only be incorporated into foot apparel that is of the variety that has an abnormally large heel, such as a high heel shoe. Such an arrangement would not be able to be satisfactorily incorporated into foot apparel not having such large heels, such as athletic footwear.

U.S. Pat. No. 4,771,556 issued to Kim discloses an arrangement wherein a circuit panel is mounted directly on the upper portion of the shoe for producing a speaker drive signal when activated. Separate from the circuit panel is a speaker, that is mounted in the heel of the shoe and which is responsive to the speaker drive signal that is generated by the circuit panel. The power supply is in the form of a photovoltaic cell that is also remote from the circuit panel and the speaker (although connected thereto). The power supply activates the circuit panel when the "VELCRO" type closure has been opened to expose the cell.

While being useful for its purpose, the Kim arrangement involves several separate components, each of which must be mounted separately. This arrangement does not present a unitary device. Use of such a device would necessitate substantial modification of the shoe, which is impractical. Also, the arrangement of Kim requires that the shoe be opened/closed for activation/-deactivation of the power supply, so that the composition may be broadcast. No button whatsoever, or any other similar means that operates apart from the opening/closing of the shoe has been disclosed for this purpose.

I am also aware that there are arrangements wherein unitary electronic assemblies are incorporated into greeting cards for generating and broadcasting audible signals in the form of musical compositions and messages. However, like the Kim '556 patent, these cards must be opened and closed in order to activate and deactivate the power supply. Additionally, it has never been suggested to incorporate such a unitary electronic assembly into an athletic shoe or any other foot apparel.

Accordingly, it can be seen that there remains a need for an arrangement wherein an athletic shoe is combined with a unitary electronic assembly capable of both electrically generating and broadcasting an audible signal in the form of a musical composition, message or the like.

SUMMARY OF THE INVENTION

It is the primary object of the present invention to provide an arrangement, wherein a unitary electronic assembly capable of generating and broadcasting an audible signal in the form of a musical composition, message or the like is incorporated in combination with an athletic shoe without substantial modification of the shoe.

It is another object of the present invention to provide such a unitary electronic assembly which may be easily and simply removed from the shoe, so as to be replaceable with another assembly having the same, or a different audible signal.

It is yet another object of the present invention to provide such a combination, wherein the assembly may be selectively and easily activated regardless of whether the shoe is either secured to, or unsecured from, the user's foot.

It is a further object of the present invention to provide such an assembly that may be incorporated in combination with athletic footwear, so as to appeal to children of all ages.

It is a still further object of the present invention to provide such an arrangement that is simple, inexpensive and easy to use.

In accordance with the teachings of the present invention, there is disclosed a unitary assembly that is combined with an athletic shoe having a pocket means. The unitary assembly is received in the pocket means, and means are provided for retaining the unitary assembly in the pocket means. The unitary assembly comprises a board carrying a battery, a microchip, an on/off switch and a speaker means. These components (the battery, microchip, switch and speaker) are electrically connected together. A push button is carried by the shoe, and the push button overlays the on/off switch when the unitary assembly is received in the pocket means. In this fashion, the button may be pushed to close the on/off switch, so as to energize the microchip from the battery, thereby generating an audible signal.

In accordance with the further teachings of the present invention, disclosed herein is a unitary electronic assembly in combination with an athletic shoe having a pocket formed therein. The unitary electronic assembly provides for generating and broadcasting an audible signal. The assembly is disposed in the pocket for being carried by the athletic shoe. The assembly includes a board and a microchip for generating an audible signal when energized. The assembly further includes a battery for energizing the microchip, so that the audible signal is generated thereby and an on/off switch that is between the battery and the microchip for selectively controlling the energizing of the microchip, whereby the generation of the audible signal may be selectively controlled. The assembly still further includes a speaker for receiving the audible signal generated by the microchip and for broadcasting the audible signal received thereby. The battery, the microchip and the speaker are all electrically connected together. Also, the battery, the microchip and the speaker are all carried by the board, whereby the unitary electronic assembly is formed.

These and other objects of the present invention will become readily apparent from a reading of the following description when taken in conjunction with the appended drawings.

BRIEF DESCRIPTION OF THE DRAWINGS

FIG. 4 corresponds substantially to FIG. 3 but shows how the push button may be depressed to generate the inspirational message, song, or the like.

DESCRIPTION OF PREFERRED EMBODIMENTS

Figure 1:
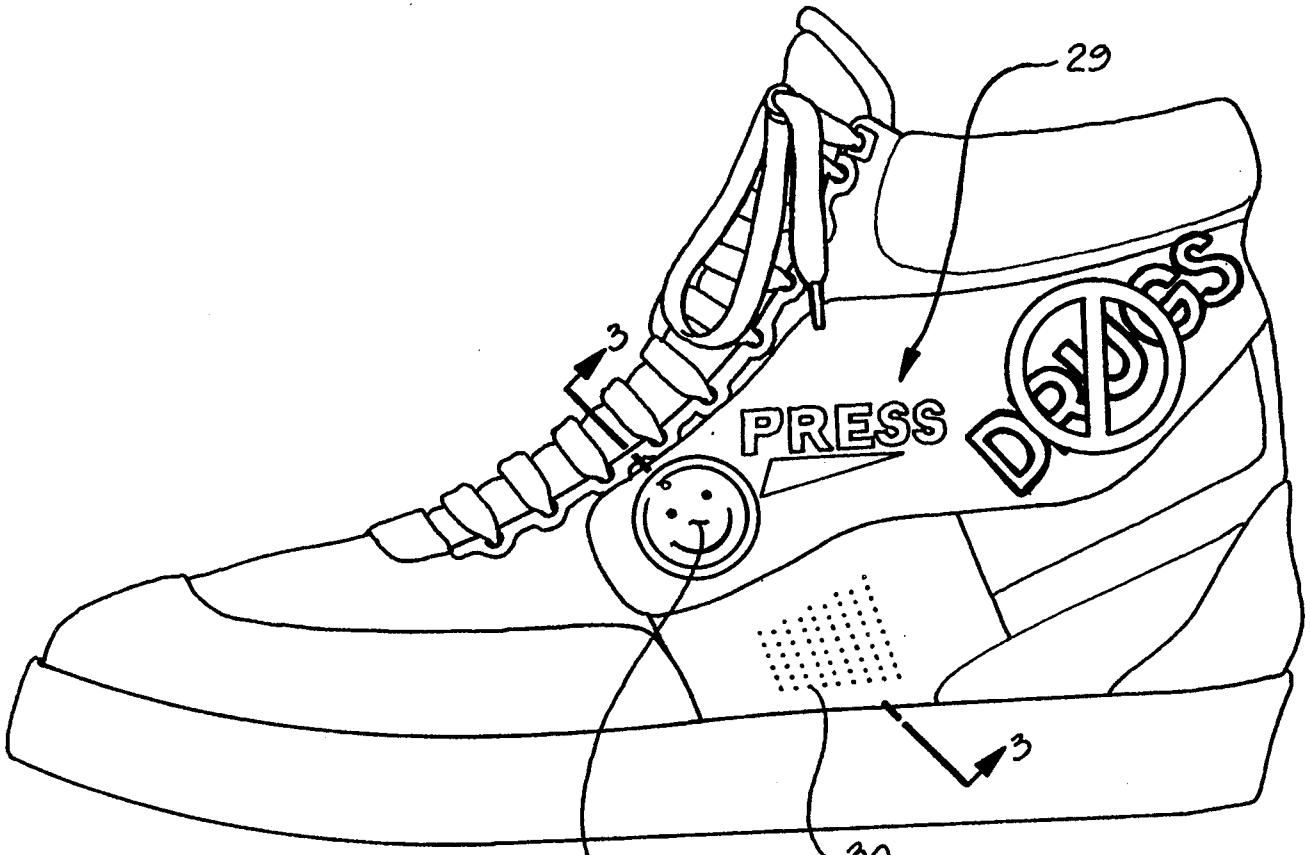
FIG. 1 is a side elevation of an athletic shoe, such as a basketball shoe, having a push button selectively activated to generate an audible signal, such as an inspirational message.
Figure 2:
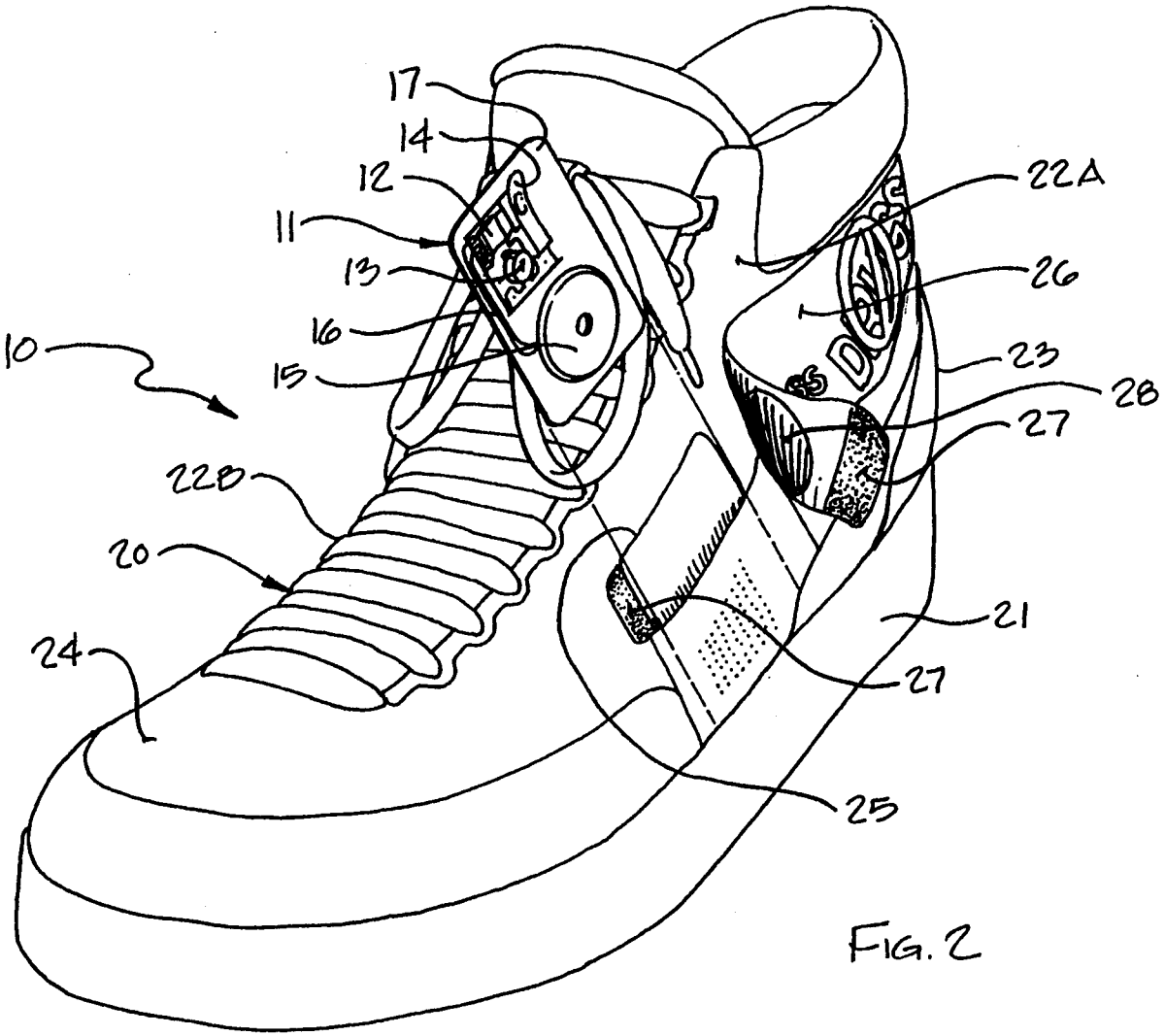
FIG. 2 is a perspective view of the athletic shoe of FIG. 1, but showing a flap lifted away from the shoe to enable a unitary assembly to be slidably removed from a pocket formed on the inner side portion of the shoe.
Figure 3:
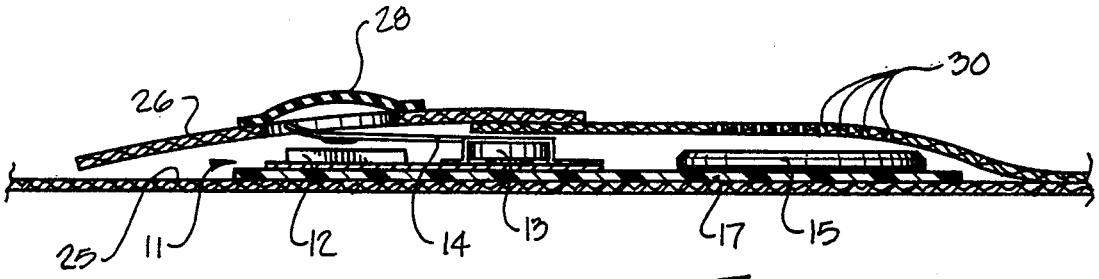
FIG. 3 is a section view taken across the lines 3—3 of FIG. 1 and showing the push button overlaying an on/off switch on the unitary assembly.
Figure 4:
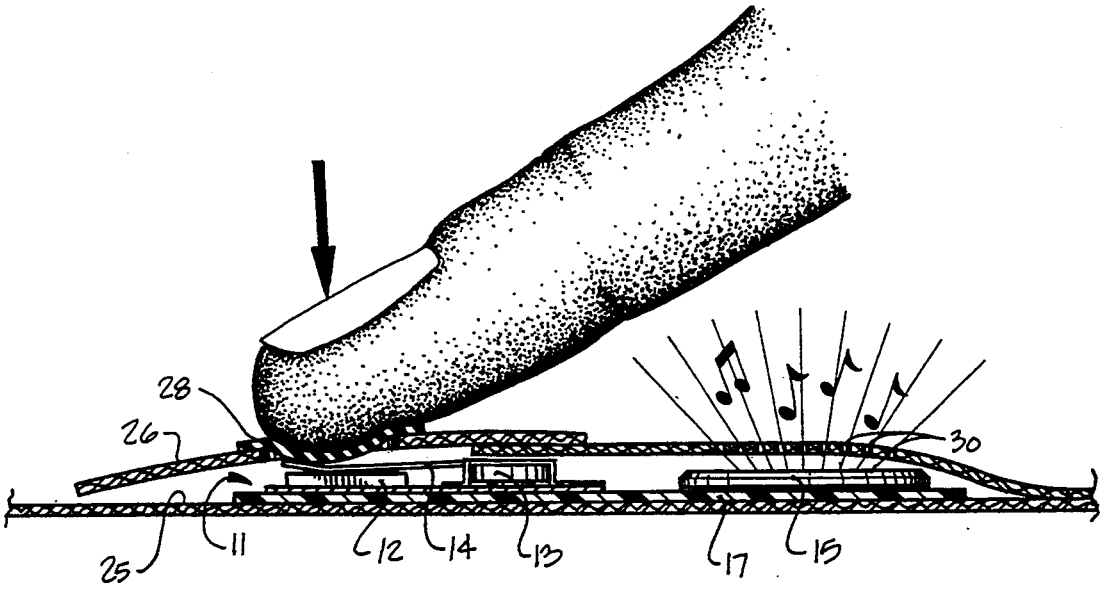
Figure 5:
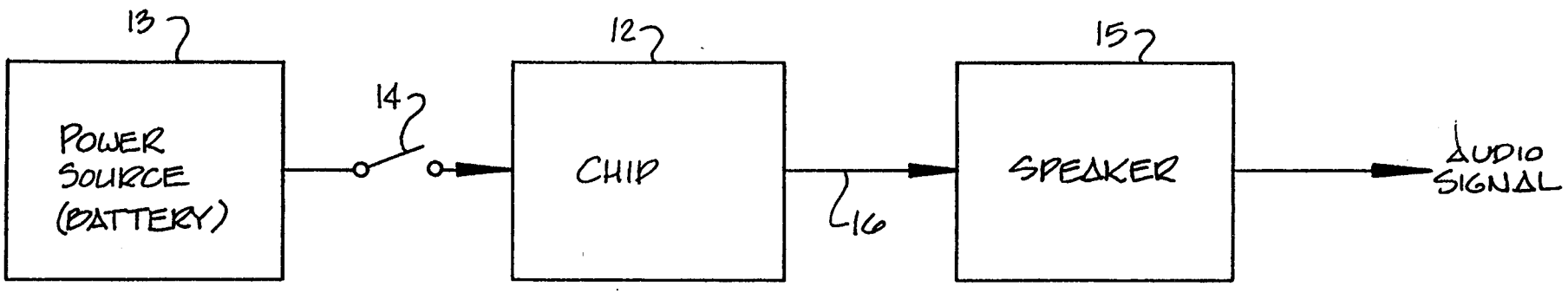
FIG. 5 is a block diagram showing, substantially, the electrical connections between the components of the unitary assembly, including a battery, microchip and speaker.

Referring to the drawings, the combination 10 of the present invention comprises a unitary electronic assembly 11 (for generating and broadcasting an audible signal) and an athletic shoe 20 which carries the assembly 11.

The unitary electronic assembly 11 includes a microchip 12, a battery 13, a spring-loaded normally "open" on/off switch 14, a speaker 15, a means 16 for electrically connecting the microchip 12, battery 13, switch 14 and speaker 15 together, and a substantially flat, planar assembly board 17.

The microchip 12, carried by the assembly board 17, contains an audible signal, in the form of a musical composition, a message or the like, which is generated when energized. The microchip 12 may be any conventional microchip, which is well known to those skilled in the art, and which is useful for this purpose.

The battery 13 is also carried by the assembly board 17. This battery 13 is provided for energizing the microchip 12, so that the audible signal is generated thereby. Preferably, this battery 13 is a standard flat electrical battery, but any suitable battery 13 or power source may be utilized, especially those which are compact.

The on/off switch 14, which is also carried by the assembly board 17, is normally open. The switch 14 is associated with the battery 13 and the microchip 12 to selectively control the energizing of the microchip 12. When the switch 14 is closed, the microchip 12 may be energized by the battery 13. In this fashion, the generation of the audible signal may be selectively controlled.

The speaker (or speaker means) 15 is also carried by the assembly board 17. This speaker 15 receives the signal generated by the microchip 12 and then converts it to a broadcasted audible signal.

The microchip 12, battery 13, switch 14 and speaker 15 are electrically connected together by any suitable means, such as electrical wires 16 (or an equivalent printed circuit). This means 16 is also carried by the assembly board 17, so that a unitary electrical assembly is provided.

The combination 10 of the present invention includes the conventional athletic shoe 20 having a sole 21. Attached to the sole 21 are respective sides, including an inner side 22*a* and an outer side 22*b*, as well as a back (or heel) side 23. A portion of the sides 22*a* and 22*b* extend across the shoe, above the sole 21, so as to form a shoe top 24.

A pocket means 25 is formed on one of the sides (preferably the inner side 22*a*) of the shoe 20. Preferably, this pocket 25 is formed so that the open end thereof (the end through which the assembly 11 is disposed into the pocket 25) is oriented upwardly, so that when the assembly 11 is disposed therein, it will not fall out by reason of gravity.

The shoe 20 further includes a flap 26 that is carried by the shoe 20 and which may be disposed overlying at least a portion of the pocket means 25. Respective hook-and-loop fasteners 27 are carried by the shoe 20 and the flap 26, respectively. In this manner, the flap 26 may be lifted up to enable the unitary assembly 11 to be selectively removed from the pocket means 25. Further in this manner, the flap 26 may be lowered to enable the unitary assembly 11 to be selectively retained in the pocket means 25.

With respect to the above, the flap 29 and the fasteners 27 define means for selectively closing the pocket 25, and removably retaining the unitary assembly 11 within the pocket means 25. Such a means is useful for permitting the assembly 11 to be selectively removed from the pocket 25, as desired. This permits the assemblies 11 to be repaired (such as, for example, to replace a dead battery), or to be replaced with a different unitary assembly bearing a different audible signal.

Finally, the combination of the present invention includes a push button 28 that is associated with the on/off switch 14 for being pushed to close the switch 14, so as to energize the microchip 12. This push button 28 may be carried by either the shoe 20 or by the switch 14 itself. When carried by the shoe 20, it is contemplated herein that the button 28 will be carried by either the pocket 25 or by the flap 26, overlying the switch 14.

The push button 28 is easy to operate, thereby facilitating the use of the combination 10, especially among children or younger individuals to whom the messages are directed. One such message is one imploring children not to use drugs.

When the button 28 (or its equivalent) is pushed or otherwise activated, the switch 14 is closed and the message is generated; and when the user's finger is taken off of the push button 28, the switch 14 returns to its normal closed position and the message is eventually discontinued. In a preferred embodiment, one need only press the button once and, thereafter, the entire message (or song) is played, even though the user's finger is removed from the button. It is not necessary to maintain continuous pressure on the push button 28.

It is further preferred, as is seen in the drawings, for the push button 28 to include a visual means 29. This visual means 29 is provided mainly for visually indicating the location of the push button 28. This visual means 29 is also useful for encouraging potential users of the combination 10 to activate (that is, close) the switch 14 and to listen to the broadcasted message, musical composition and the like.

The visual means 29 employed may be any means well known to those skilled in the art for such purpose. An example of such a visual means 29 may include a visual design or graphics. Another example is printed words, such as "PRESS", or any other expression or admonishment. It is especially preferred that this visual means 29 includes both such visual designs, as well as printed words.

The audible signal generated by the speaker 15 passes through perforations 30 in the pocket 25 of the shoe 20.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An athletic shoe with a replaceable interchangeable unitary assembly for generating and broadcasting an audio signal, comprising an athletic shoe having a pocket formed therein, the pocket having an opening, a self-contained interchangeable unitary circuit board inserted through the opening and into the pocket, the self-contained interchangeable unitary circuit board having a microchip, on/off switch, battery and speaker integrally mounted thereon, such that the self-contained interchangeable unitary circuit board may be readily removed and replaced, a flap carried by the shoe and covering the opening in the pocket, and the flap having a conspicuously-displayed button means thereon overlaying the switch on the self-contained interchangeable unitary circuit board, such that the button means may be pressed to close the on/off switch to generate and broadcast an audio signal, regardless of whether the shoe is being fastened or unfastened, and at the discretion of the wearer.

2. The athletic shoe of claim 1, wherein the pocket has perforations formed therein, the perforations being disposed below the flap and overlaying the speaker on the unitary circuit board.

3. The athletic shoe of claim 2, wherein the shoe has a rearward counter portion, and wherein the flap is mounted on the rearward counter portion of the shoe and extends forwardly therefrom transversely of the pocket and the direction in which the unitary circuit board is inserted into the pocket.

4. In combination, an article of apparel including a pocket having a closure, a self-contained interchangeable unitary circuit board including a battery, speaker, microchip and on/off switch thereon, the self-contained interchangeable unitary circuit board being received within the pocket and providing an audible sound, and the pocket having a switch indicator conspicuously displayed thereon and overlaying the on/off switch on the self-contained interchangeable circuit board, such that the switch indicator may be pressed to depress the pocket to close the on/off switch thereby delivering the audible sound, and such that the closure may be opened to conveniently remove the self-contained interchangeable unitary circuit board from the pocket for replacement purposes.

5. The combination of claim 4, wherein the article of apparel comprises footwear.

6. The combination of claim 5, wherein the footwear comprises an athletic shoe.

7. In combination, an athletic shoe including a pocket having a closure, a plurality of self-contained interchangeable unitary circuit boards, including at least first and second self-contained interchangeable unitary circuit boards, each of which includes a battery, speaker, microchip and on/off switch thereon, and each of which generates a distinct audio sound, such that the first self-contained interchangeable unitary circuit board may be received within the pocket, the pocket having a switch indicator conspicuously displayed thereon and overlaying the on/off switch on the first self-contained interchangeable circuit board, and such that the switch indicator may be pressed to depress the pocket to close the on/off switch thereby delivering the desired audible sound, such that the closure may be opened to conveniently remove the first self-contained interchangeable unitary circuit board from the pocket, and such that the second self-contained interchangeable unitary circuit board thereafter may be inserted within the pocket.

* * * * *